US006611097B1

(12) United States Patent
Hanahara et al.

(10) Patent No.: US 6,611,097 B1
(45) Date of Patent: Aug. 26, 2003

(54) ELECTROLUMINESCENT ELEMENT COMPRISING REDUCED NUMBER OF PARTS AND LIGHTING UNIT HAVING THE SAME

(75) Inventors: Tetsuro Hanahara, Fukui (JP); Minoru Hato, Osaka (JP); Shinji Okuma, Fukui (JP); Yoshiharu Abe, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 190 days.

(21) Appl. No.: 09/618,182

(22) Filed: Jul. 18, 2000

(30) Foreign Application Priority Data

Jul. 21, 1999 (JP) ..... 11-205944

(51) Int. Cl.[7] ..... H01J 1/62; H01J 63/04

(52) U.S. Cl. ..... 313/506; 313/498; 313/503; 428/690

(58) Field of Search ..... 313/506, 501, 313/509, 503, 498; 428/690, 917

(56) References Cited

U.S. PATENT DOCUMENTS

| | | | | |
|---|---|---|---|---|
| 4,792,723 A | | 12/1988 | Igarashi et al. | 313/503 |
| 5,552,668 A | | 9/1996 | Hirose et al. | 313/506 |
| 5,586,879 A | | 12/1996 | Szpak | 445/24 |
| 5,726,231 A | | 3/1998 | Namiki et al. | 524/413 |
| 5,770,920 A | | 6/1998 | Eckersley et al. | |
| 5,783,292 A | | 7/1998 | Tokito et al. | 428/212 |
| 5,841,230 A | * | 11/1998 | Ikoma et al. | 313/506 |
| 5,847,783 A | | 12/1998 | Hiramoto et al. | 349/69 |
| 5,949,188 A | * | 9/1999 | Leising et al. | 313/505 |
| 5,981,092 A | * | 11/1999 | Arai et al. | 428/690 |
| 6,222,314 B1 | * | 4/2001 | Arai et al. | 313/506 |
| 6,284,394 B1 | * | 9/2001 | Arai et al. | 428/690 |

FOREIGN PATENT DOCUMENTS

| | | |
|---|---|---|
| EP | 0753985 | 1/1997 |
| EP | 0 879 867 | 11/1998 |
| JP | 01010595 | 1/1989 |
| JP | 05326147 | 12/1993 |
| JP | 11219791 | 8/1999 |
| JP | 11329725 | 11/1999 |

* cited by examiner

*Primary Examiner*—Vip Patel
*Assistant Examiner*—Kevin Quarterman
(74) *Attorney, Agent, or Firm*—RatnerPrestia

(57) ABSTRACT

An elecroluminescence (EL) element emits light from its both surfaces. The EL element is formed by printing front electrode layer, luminescent layer made of high dielectric resin with luminous powder dispersed therein, and rear electrode layer made of light-transmittable resin with conductive powder dispersed therein on at least one of surfaces of insulating film.

16 Claims, 4 Drawing Sheets

ELECTROLUMINESCENT ELEMENT COMPRISING REDUCED NUMBER OF PARTS AND LIGHTING UNIT HAVING THE SAME

FIELD OF THE INVENTION

This invention relates to an electroluminescence element used as a back-lighting of a display section and a control section in an electronic device and a lighting unit having the electroluminescence element.

BACKGROUND OF THE INVENTION

Recently, as the diversification of an electronic device increase, device having a back-lighting behind a liquid crystal display (LCD), a display panel or switch keys, such that the display section and the control section can be identified and controlled in darkness, has increased. An electroluminescence element (it is called an EL element hereinafter) has been used as a back-lighting.

A conventional EL element used for this purpose is described with FIG. 7 and FIG. 8. The drawings are enlarged in a direction of the thickness for clarity of its configuration.

FIG. 7 is a cross sectional view of the conventional EL element. El element 6 has a laminated structure of the following layers and is formed by printing in order named;

(a) flexible light-transmittable insulating film 1 made of polyethylene terephtalate or the like; and (b) light-transmittable insulating front electrode layer 2, which is made of indium tin oxide (it is called ITO hereinafter), formed on the entirely underneath film 1 by a spattering process or an electron beam process;

(c) luminescent layer 3 dispersed luminous powder, which is luminescent base material such as zinc sulfide, in high dielectric resin such fluoro-contained rubber, cyan-base resin or the like, underneath front electrode layer 2, (d) rear electrode layer 4 dispersed silver or carbon resin in epoxy resin, polyester or the like;

(e) insulating layer 5 made of epoxy resin, polyester resin or the like.

EL element 6 with configuration described above is disposed in an electronic device. When an alternating voltage is applied between front electrode layer 2 and rear electrode layer 4 from the electronic device (not shown), luminescent layer 3 in EL element 6 is actuated and EL element 23 emits light from the top of insulating film 1. This light illuminates the LCD and the display panel from the rear in the electronic device. Therefore the display section and the control section can be identified in the dark.

When illuminating both sides of the electronic device, two EL elements 6 are placed so as to be opposed each insulating layer 5 of two EL elements back to back as shown in a cross sectional view in FIG. 8. When converting color of light and illuminating with multiple-color lights, two EL elements 6 having different luminescent colors are combined.

However, in the conventional EL element described above, when illuminating both surfaces of the electronic device, entire EL element is thick and the number of parts are increased because of combining two EL elements into one. This allows the electronic device to be more expensive.

SUMMARY OF THE INVENTION

The invention provides an EL element emitting light from its both surfaces, which is thinner and inexpensive by decreasing the number of parts, and a lighting unit having it. The EL element has a laminated structure of the following layers and is formed by printing in order named;

(1) a light-transmittable insulating film;

(2) a front electrode layer;

(3) a luminescent layer made by dispersing powdery fluorescent substance into high dielectric resin; and (4) a light-transmittable rear electrode layer made by dispersing conductive powder into light-transmittable resin.

When forming the EL element having a structure the same as described above on both sides of the insulating film, a thinner double-side-lighting EL element is provided when compared to both-sided lighting by the conventional EL element combined two about separate EL elements. Further, the EL element for multiple-color lighting from both surfaces can be provided by using luminescent layers having different luminescent colors respectively. Furthermore, in the case of using a light-transmittable insulating film and a plurality of light-transmittable front electrode layers, in addition to a first and a second colors of each luminescent layer, a third color is produced by merging the first and second colors when emitting two luminescent layers simultaneously.

DESCRIPTION OF THE PREFERRED EMBODIMENTS

Exemplary embodiments of the invention are described hereinafter with reference to FIGS. 1 through 6. The parts corresponding to the layers shown in the description of the related art are identified with the same numeral. The detail description for them is omitted.

Embodiment 1

Figure 1:
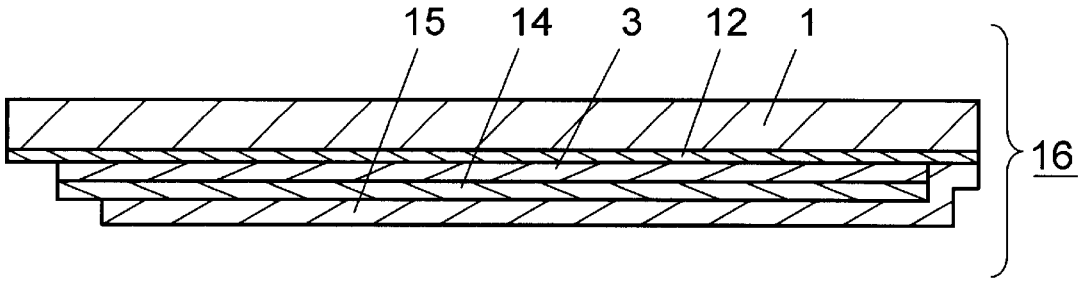
FIG. 1 is a cross sectional view of an EL element in accordance with a first exemplary embodiment of the invention.

FIG. 1 is a cross sectional view of electroluminescent element 16 (it is called EL element 16 hereinafter) in a first embodiment. EL element 16 is formed by printing the following layers in order named, (a) light-transmittable insulating film 1 with flexibility such as polyethylene terephthalete or the like;

(b) front electrode layer 12 formed by printing flexible light-transmittable resin, which is produced by dispersing conductive powder such as needle-shaped indium tin oxide(it is called ITO hereinafter) or the like in phenoxy resin, epoxy resin or fluorine-contained rubber, entirely underneath the surface of film 1;

(c) luminescent layer 3 formed by dispersing luminous powder which emits light when electric field is applied such as zinc sulfide in high dielectric resin such as fluorine-contained rubber or cyano-based resin underneath front electrode layer 12;

(d) light-transmittable rear electrode layer 14 formed by dispersing silver or carbon resin in epoxy resin, ester resin or the like; and (e) light-transmittable insulating layer 15 made of epoxy resin, polyester resin or the like.

El element 16 described above is disposed in an electronic device (not shown), an alternating voltage is applied between front electrode layer 14 and rear electrode layer 14, then luminescent layer 3 is actuated and emits light. The emitted light illuminates the top surface of insulating film 1 through front electrode layer 12 and the bottom surface of light-transmittable insulating layer 15 through rear electrode layer 14. The light emitted from both surfaces illuminates a liquid crystal display (LCD) or a display panel from the rear. Therefore, a display section or a control section is identified even in the dark.

In this embodiment, EL element 6 is formed by printing front electrode 12, luminescent layer 3 and rear electrode layer 14 in order named on one surface of insulating film 1, as a result, a thin EL element can be produced. Moreover, a inexpensive EL element emitting light from the both surfaces and having a fewer parts can be provided.

Zinc sulfide is used as a luminescent powder, however, any luminescent power which emits under an electric field can be used.

Light-transmittable front electrode 12 is formed by printing with flexible resin dispersed powdery elemental materials. Therefore, a flexible EL element which can be folded and mounted on a curved plane is produced.

Moreover, rear electrode layer 14 is covered with light-transmittable insulating layer 15. As a result, the EL element is securely insulated from other electronic parts placed in close proximity to the EL element in the electronic device or the outside.

Figure 2:
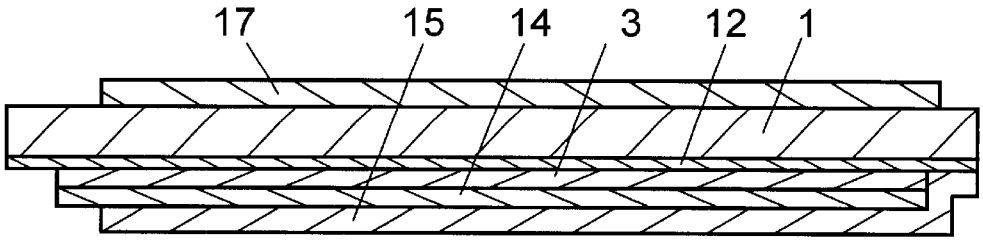
FIG. 2 is a cross sectional view of an EL element added color-conversion layer into the EL element shown in FIG. 1.

FIG. 2 is a cross sectional view of an EL element formed by printing color converting layer 17 which is produced by dispersing luminous dyes or luminous pigments into light-transmittable polyester resin, epoxy resin, acrylic resin, phenoxy resin or fluorine-contained rubber on the top surface of insulating layer 1. Color of light emitted from the top surface of the EL element is converted by color-converting layer 17 and can be different from own luminescent color of luminescent layer 3 emitted from the bottom surface. Therefore, without changing luminescent color of luminescent layers, multiple-color emitting EL element having various luminescent colors is produced.

In the above description, color converting layer 17 is formed by printing on the top surface of insulating layer 1. Even when color-converting layer 17 is also formed by printing on each surface of front electrode layer 12 or rear electrode layer 14 respectively, or the bottom surface of light-transmittable insulating layer 15, similar effect is obtained.

Embodiment 2

Figure 3:
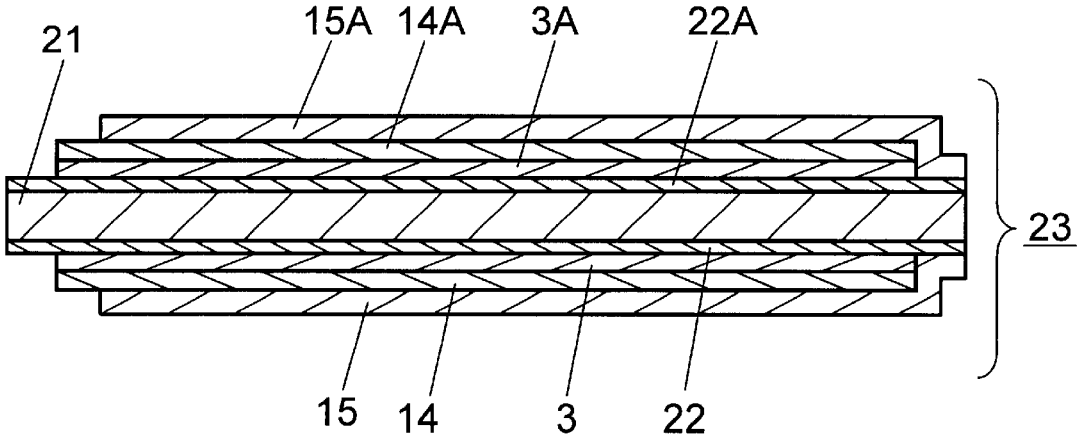
FIG. 3 is a cross sectional view of an EL element in accordance with a second exemplary embodiment of the invention.

FIG. 3 is a cross sectional view of EL element 23 in a second preferred embodiment. EL element 23 has a laminated structure and is formed by printing the following layers in order named, (a) insulating film 21 with flexibility such as polyethylene terephthalete or the like;

(b) front electrodes 22, 22A formed by printing flexible resin, which is produced by dispersing conductive powder such as needle-shaped ITO or the like in phenoxy resin, epoxy resin or fluorine-contained rubber, on the entire both surfaces of film 21;

(c) luminescent layers 3, 3A, which are disposed by dispersing luminous powder such as zinc sulfide or the like so as to be luminescent base material in high electric resin such as fluorine-contained rubber or cyano-based resin, formed by printing on both surfaces of front electrode layer 22, 22A;

(d) light-transmittable rear electrode layer 14, 14A disposed by dispersing silver or carbon resin in epoxy resin polyester resin or the like;

(e) light-transmittable insulating layer 15, 15A made of epoxy resin, polyester resin or the like.

When EL element 23 with configuration as described above is placed in an electronic device and then an alternating voltage is applied between front electrode layer 22 and rear electrode layer 14 from a circuit (not shown) in the electronic device, luminescent layer 3 in EL element 23 is actuated and emits light. The light illuminates the underneath surface of light-transmittable insulating layer 15 through light-transmittable rear electrode layer 14.

When an alternating voltage is applied between front electrode layer 22A and rear electrode layer 14A similarly, luminescent layer 3A is actuated and emits light as well. The light illuminates the top surface of light-transmittable insulating layer 15A through light-transmittable rear electrode layer 14A. The light emitted from both surfaces illuminate a LCD or a display panel from the rear in the electronic device. Therefore, a display section or a control section in the electronic device is identified even in the dark.

In this case, luminescent colors from each of luminescent layers 3, 3A are not necessarily the same. For example, when luminescent colors of luminescent layers 3 and 3A are defined blue and orange respectively, a variety of lighting is provided.

In this embodiment, two EL elements are formed by printing respectively on both surfaces of insulating film 21. As a result, the number of parts used for the EL element can be decreased and a thinner EL element can be provided when compared to both-sided lighting by the conventional EL element combined two separate EL elements. Further, EL element 23 so as to achieve multiple-color lighting from both the top and the bottom surfaces thereof can be provided by using luminescent layers 3, 3A having different luminescent colors respectively.

Figure 4:
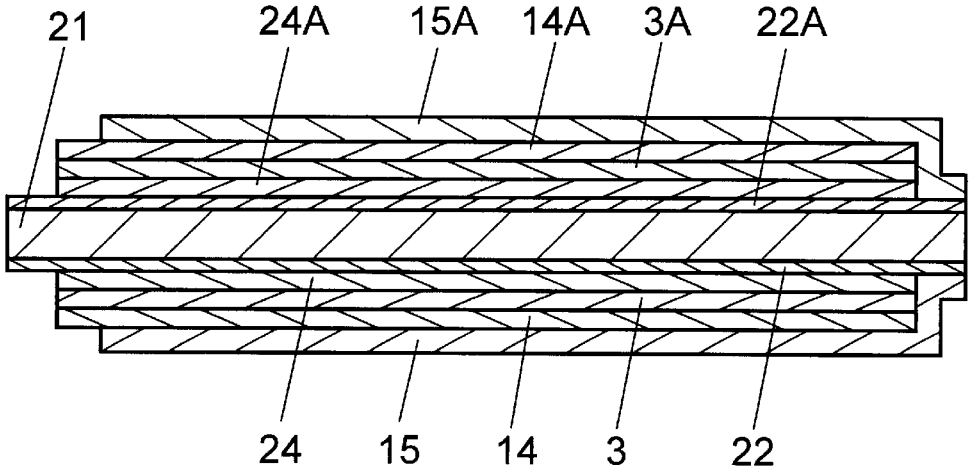
FIG. 4 is a cross sectional view of an EL element formed by laminating a dielectric layer on the EL element shown in FIG. 3.

FIG. 4 is a cross sectional view of another EL element 23 formed by printing dielectric layer 24, 24A—which are made of high dielectric resin such as fluorine-contained rubber or cyano-based resin dispersed high dielectric powder such as barium titanate or the like therein—between front electrode layer 22 and luminescent layer 3, and then between front electrode layer 22A and luminescent layer 3A respectively. This allows EL element 23 to provide secure insulation between front electrode layer 22 and rear electrode layer 14 and between front electrode layer 22A and rear electrode layer 14A. The luminescent intensity is further increased because a voltage applied to luminescent layers 3, 3A is higher than a voltage applied to dielectric layers 24, 24A when dielectric layers 24, 24A have a proper thickness to keep insulation.

In the above description, dielectric layers 24, 24A are formed by printing between front electrode layers 22, 22A and luminescent layers 3, 3A respectively. Even when dielectric layers 24, 24A are formed by printing between luminescent layers 3, 3A and rear electrode layers 14, 14A respectively, similar effect is obtained.

Embodiment 3

Figure 5:
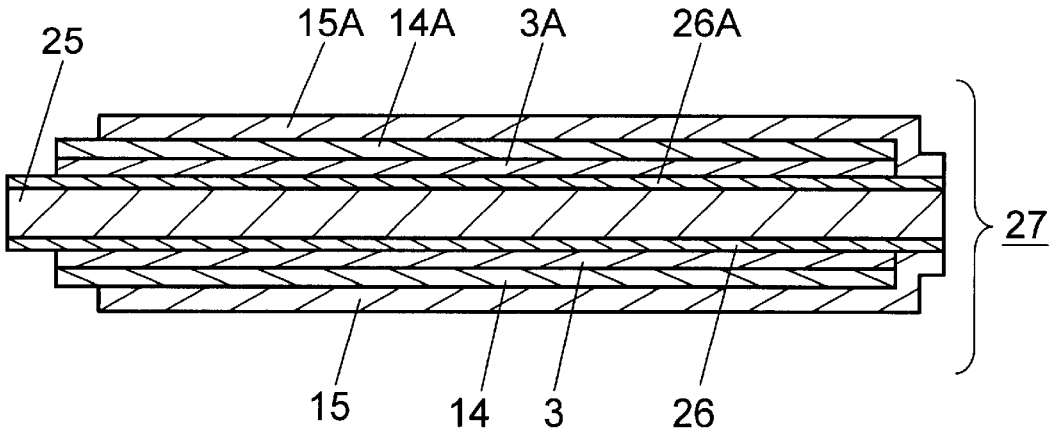
FIG. 5 is a cross sectional view of an EL element in accordance with a third exemplary embodiment.

FIG. 5 is a cross sectional view of EL element 27 in a third embodiment. EL element 27 has a laminated structure formed by printing front electrode layers 26, 26A, luminescent layers 3, 3A, rear electrode layers 14, 14A and light-transmittable insulating layers 15, 15A respectively in order named on entire both surfaces of insulating film 25 as well as the second embodiment. Insulating film 25 and front electrode layers 26, 26A in EL element 27 are light transmittable.

When EL element 27 is disposed in the electronic device and the alternating voltage is applied between front electrode layer 26 and rear electrode layer 14, for example, in the case that luminescent color of luminescent layer 3 is blue, blue light is emitted from the bottom surface of light-transmittable insulating layer 15.

When the alternating voltage is applied between front electrode layer 26A and rear electrode layer 14A, for example, in the case that luminescent color of luminescent layer 3 is orange, orange light is emitted from the top surface of light-transmittable insulating layer 15A. The light emitted from both surfaces of EL element 27 illuminates a LCD or a display panel in the electronic device from the rear as well the second embodiment.

When the alternating voltage is applied simultaneously between front electrode layer 26, 26A and rear electrode layer 14, 14A respectively, blue luminescent color of luminescent layer 3 and orange luminescent color of luminescent layer 3A are emitted simultaneously. Entire EL element 27 emits white light produced by merging the two luminescent colors, blue and orange, because insulating film 25 and front electrode layers 26, 26A are light transmittable.

According to this embodiment, EL element 27 emits three-different-color lights from both surfaces thereof. In addition to a first and a second colors depending on each luminescent color of luminescent layers 3, 3A, a third color is produced by merging the first and the second colors when emitting light from luminescent layers 3, 3A simultaneously.

Embodiment 4

Figure 6:
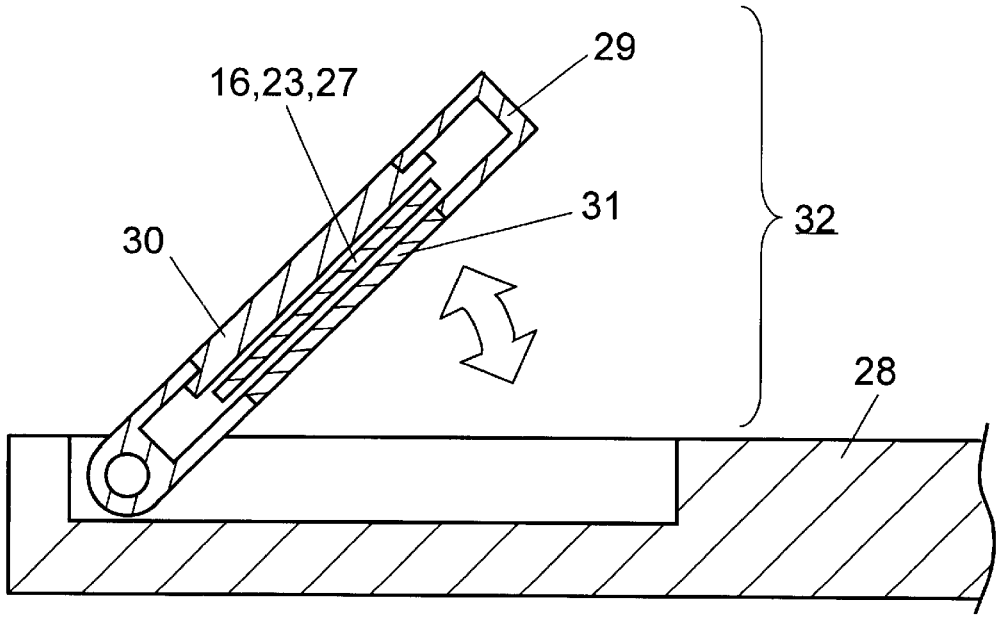
FIG. 6 is a cross sectional view of a lighting unit in accordance with a fourth exemplary embodiment.
Figure 7:
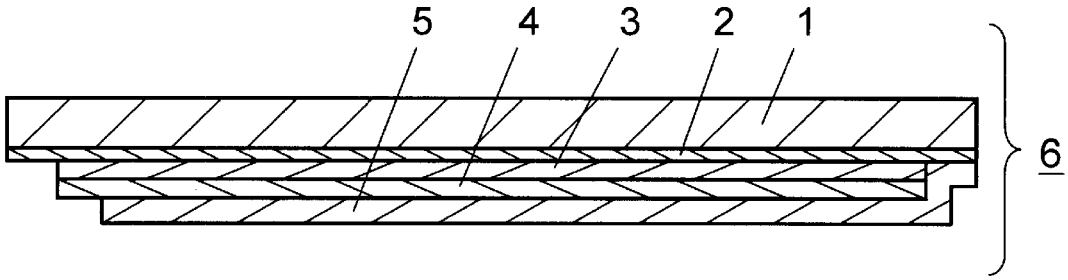
FIG. 7 PRIOR ART
FIG. 7 is a cross sectional view of a conventional EL element.
Figure 8:
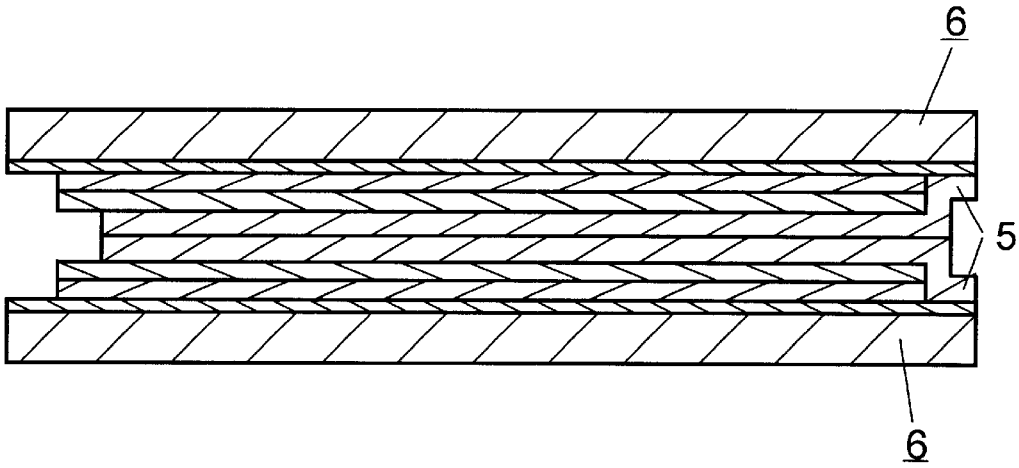
FIG. 8 PRIOR ART
FIG. 8 is a cross sectional view of a conventional double-sided emitting EL element produced by combining two EL elements.

FIG. 6 is a cross sectional view of a lighting unit in a fourth preferred embodiment. One of EL elements 16, 23 and 27 described in the above preferred embodiments 1, 2 and 3 is disposed in the center of enclosure 29 as a lid of electronic device 28 such as a video camera, a portable audio device or the like. LCD 30 is disposed on the top surface of enclosure 29 and display panel 31 is disposed underneath enclosure 29 so as to hold EL elements 16, 23 or 27 between LCD 30 and display panel 31.

In this configuration, when a light emitted from the top surface of EL elements 16, 23 or 27 is blue and a light emitted from the bottom surface of them is orange, LCD 30 is illuminated blue in a close condition of lighting unit 32. Display panel 31 is illuminated orange in an open condition of lighting unit 32.

According to this embodiment, one of EL elements 16, 23 and 27 is placed in the center of enclosure 29, lighting unit 32 is formed by placing LCD 30 and display panel 31 on both surfaces of the EL element. As a result, a thinner and inexpensive lighting unit with a fewer parts, which emits light from both surfaces thereof, can be produced.

What is claimed is:

1. An electroluminescence element comprising;

a light-transmittable insulating film;

a light-transmittable front electrode layer formed over at least a portion of said light-transmittable insulating film;

a luminescent layer made of high dielectric resin with luminescent powder dispersed therein over said front electrode layer;

a light-transmittable rear electrode layer made of light-transmittable resin with conductive powder dispersed therein over said luminescent layer;

a light-transmittable insulating layer made of light-transmittable resin over said rear electrode layer, and a dielectric layer made of high dielectric resin with high dielectric powder dispersed therein over said luminescent layer.

2. The electroluminescence element of claim 1, wherein the light-transmittable front electrode is formed on at least a portion of said light-transmittable insulting film.

3. The electroluminescence element of claim 1, wherein the luminescent powder emits under an electric field.

4. An electroluminescence element comprising;

a light-transmittable insulating film;

a light-transmittable front electrode layer formed over at least a portion of said light-transmittable insulating film;

a luminescent layer made of high dielectric resin with luminescent powder dispersed therein over said front electrode layer;

a light-transmittable rear electrode layer made of light-transmittable resin with conductive powder dispersed therein over said luminescent layer;

a light-transmittable insulating layer made of light-transmittable resin over said rear electrode layer, and a color converting layer made of light-transmittable resin with one of luminous dyes and luminous pigments dispersed therein over at least one of said insulating film, said front electrode layer and said rear electrode layer.

5. The electroluminescence element of claim 4, wherein the light-transmittable front electrode is formed on at least a portion of said light-transmittable insulting film.

6. The electroluminescence element of claim 4, wherein the luminescent powder emits under an electric field.

7. An electroluminescence element comprising:

an insulating film;

a plurality of front electrode layers formed on respective top and bottom surfaces of said insulating film;

plurality of luminescent layers made of high dielectric resin with luminescent powder dispersed therein over respective surfaces of said front electrode layers;

a plurality of light-transmittable rear layers made of light-transmittable resin with conductive powder dispersed therein on respective surfaces of said luminescent layers; and a dielectric layer made of high dielectric resin with high dielectric powder dispersed therein over both surfaces of said luminescent layers.

8. The electroluminescence element as defined in claim 7, wherein said insulating film and said front electrode layer are light transmittable.

9. The electroluminescence element as defined in claim 7, wherein said front electrode layer is made of resin with conductive powder dispersed therein.

10. The electroluminescence element as defined in claim 7 further comprises a light-transmittable insulating layer made of light-transmittable resin over both surfaces of said rear electrode layers.

11. An electroluminescence element comprising:

an insulating film;

a plurality of front electrode layers formed on respective top and bottom surfaces of said insulating film;

a plurality of luminescent layers made of high dielectric resin with luminescent powder dispersed therein over respective surfaces of said front electrode layers;

a plurality of light-transmittable rear layers made of light-transmittable resin with conductive powder dispersed therein on respective surfaces of said luminescent layers; and a color converting layer made of light-transmittable resin with one of luminous dyes and luminous pigments dispersed therein over at least one of both surfaces of said insulating layer, both surfaces of said front electrode layer and both surfaces of said rear electrode layer.

12. The electroluminescence element as defined in claim 11, wherein said insulating film and said front electrode layer are light transmittable.

13. The electroluminescence element as defined in claim 11, wherein said front electrode layer is made of resin with conductive powder dispersed therein.

14. The electroluminescence element as defined in claim 11 further comprises a light-transmittable insulating layer made of light-transmittable resin over both surfaces of said rear electrode layers.

15. A lighting unit comprising:

(a) an electroluminescence element including:

(a-1) a light-transmittable insulating film;

(a-2) a light-transmittable front electrode layer formed over at least a portion of said insulating film;

(a-3) a luminescent layer made of high dielectric resin with luminescent powder dispersed therein over said front electrode layer;

(a-4) a light-transmittable rear electrode layer made of light-transmittable resin with conductive powder dispersed therein over said luminescent layer;

(a-5) a dielectric layer made of high dielectric resin with high dielectric powder dispersed therein over said luminescent layer;

(a-6) a light-transmittable insulating layer made of light-transmittable resin over said rear electrode layer, and (b) at least one of a liquid crystal device and a display panel disposed on at least one surface of said electroluminescence element.

16. A lighting unit comprising:

(a) an electroluminescence element including:

(a-1) a light-transmittable insulating film;

(a-2) a light-transmittable front electrode layer formed over at least a portion of said insulating film;

(a-3) a luminescent layer made of high dielectric resin with luminescent powder dispersed therein over said front electrode layer;

(a-4) a light-transmittable rear electrode layer made of light-transmittable resin with conductive powder dispersed therein over said luminescent layer;

(a-5) a light-transmittable insulating layer made of light-transmittable resin over said rear electrode layer, and (a-6) a color converting layer made of light-transmittable resin with one of luminous dyes and luminous pigments dispersed therein over at least one of said insulating film, said front electrode layer and said rear electrode layer, and (b) at least one of a liquid crystal device and a display panel disposed on at least one surface of said electroluminescence element.

* * * * *